US006840372B2

(12) United States Patent
Giles et al.

(10) Patent No.: US 6,840,372 B2
(45) Date of Patent: Jan. 11, 2005

(54) UNIFORM INTERLOCKING FOAM PACKING MATERIAL/BUILDING MATERIAL APPARATUS AND METHOD

(75) Inventors: Conley W. Giles, Georgetown, TX (US); Aaron S. Williams, Austin, TX (US); Robert P. Wimmer, Austin, TX (US)

(73) Assignee: HoamFoam Alliance, Inc., Austin, TX (US)

( * ) Notice: Subject to any disclaimer, the term of this patent is extended or adjusted under 35 U.S.C. 154(b) by 62 days.

(21) Appl. No.: 10/039,304

(22) Filed: Jan. 2, 2002

(65) Prior Publication Data

US 2002/0166860 A1 Nov. 14, 2002

Related U.S. Application Data

(60) Provisional application No. 60/290,210, filed on May 11, 2001.

(51) Int. Cl.[7] ..... B65D 81/107

(52) U.S. Cl. ..... 206/216; 52/173.1; 52/745.21; 52/747.1; 206/523; 206/586

(58) Field of Search ..... 52/741.1, 745.21, 52/747.1, 169.2, 173.1, 269; 206/216, 320–325, 453, 523, 586

(56) References Cited

U.S. PATENT DOCUMENTS

| | | | | |
|---|---|---|---|---|
| 4,711,058 A | | 12/1987 | Patton | 52/101 |
| 5,060,801 A | | 10/1991 | Vilas-Boas | 206/523 |
| 5,207,327 A | * | 5/1993 | Brondos | 206/523 |
| 5,215,195 A | * | 6/1993 | Williams | 206/446 |
| 5,347,949 A | | 9/1994 | Winston | 114/264 |
| 5,353,562 A | | 10/1994 | Decker | 52/309.7 |
| 5,649,401 A | | 7/1997 | Harrington, Jr. | 52/426 |
| 5,699,640 A | | 12/1997 | Bourgeois et al. | 52/309.4 |
| 5,766,721 A | | 6/1998 | Bussey, Jr. et al. | 428/71 |
| 5,771,648 A | | 6/1998 | Miller et al. | 52/309.7 |
| 5,839,249 A | | 11/1998 | Roberts | 52/745.08 |
| 5,845,445 A | | 12/1998 | Blackbeard | 52/426 |
| 5,887,401 A | | 3/1999 | Moore, Jr. | 52/426 |
| 5,921,046 A | | 7/1999 | Hammond, Jr. | 52/564 |
| 5,930,958 A | | 8/1999 | Stanley | 52/98 |
| 6,036,007 A | * | 3/2000 | Alejandro et al. | 206/303 |
| 6,082,543 A | * | 7/2000 | Beliveau | 206/523 |
| 6,134,853 A | | 10/2000 | Haener | 52/405.2 |
| 6,164,035 A | | 12/2000 | Roberts | 52/563 |
| 6,170,220 B1 | | 1/2001 | Moore, Jr. | 52/741.13 |
| 6,189,279 B1 | | 2/2001 | Fiechtl | 52/403.1 |
| 6,314,694 B1 | | 11/2001 | Cooper et al. | 52/309.12 |
| 6,363,683 B1 | | 4/2002 | Moore, Jr. | 52/741.13 |

* cited by examiner

*Primary Examiner*—Jim Foster

(57) ABSTRACT

A foam structure for protecting a product in a package can interlock with another foam structure, concrete or wood to form a structural unit of building material. The foam structure can be made of two nested parts, which can be made of differing materials.

A structural unit that can be used as building material can be made from packing material. A foam structure that can be used to pack a product in a package is interlocked with another foam structure, wood or concrete to form the unit of building material. The structural units can be used in construction products or in flotation products. The structural units can be used as part of a wall form and can be attached to the wall or to the other side of the wall form with connectors. The structural units can have conduits. The conduits can pass electrical conductors, air, fluids, ducts or pipes.

20 Claims, 8 Drawing Sheets

UNIFORM INTERLOCKING FOAM PACKING MATERIAL/BUILDING MATERIAL APPARATUS AND METHOD

CROSS REFERENCE TO RELATED APPLICATION

This application claims priority under 365 U.S.C. 119(e) to U.S. Provisional Application Ser. No. 60/290,210, filed May 11, 2001.

TECHNICAL FIELD OF THE INVENTION

The present invention relates generally to fabricated foam products and more specifically it relates to an interlocking packing material/building material apparatus and method for allowing the manufacture and use of uniform building components that have a pre-use life as packing materials.

BACKGROUND OF THE INVENTION

It can be appreciated that fabricated expanded polystyrene and expanded polypropylene foam products have been in use for years. Typical fabricated foam products for packaging are comprised of foam peanuts, formed cardboard from recycled pulp, injected form fitted foam, and the like. Typical fabricated foam products for building materials are stackable foam concrete molds, structural insulated panels (SIP's), foam insulation panels, and the like.

Conventional fabricated foam products have an impact on landfills. Discarded foam materials will stay in today's sealed landfills indefinitely with no decrease in structural integrity. Of greater impact than their longevity is the size and bulk of foam products when dumped into the standard landfill. Foam cannot be further compacted and thereby takes up large amount of space relative to its weight.

Conventional fabricated foam products have a single, targeted end use, for example as a protective packaging material, while any second life of the material is an afterthought. As a result, the product has limited use and the costs associated with any recycling efforts are high. There is little financial incentive to recycle conventional fabricated foam products. Additionally, there is little or no social or psychological incentive to recycle. Any foam product is perceived as a single use product, resulting in the production of foam products in separate non-interacting fields of use.

While ease of handling on the building job site and the natural insulating properties of foam make it a desirable building material, its bulk causes the cost of shipping it to be high.

The bulkiness of foam packaging materials also makes their handling, storage, and processing a time consuming, costly procedure. Conventional foam packing materials do not nest together easily. As a result, it is inconvenient to ship them from the foam fabricator to the product packager, to store them until needed for packaging products, and to count them for inventory purposes.

While these foam products may be suitable for the particular purpose for which they are designed, they are not suitable for allowing the manufacture and use of uniform building components that have a pre-use life as packaging materials.

In these respects, the uniform interlocking packing material/building material system according to the present invention substantially departs from the conventional concepts and designs of the prior art, and in so doing provides an apparatus primarily developed for the purpose of allowing the manufacture and use of uniform building components that have a pre-use life as packaging materials.

SUMMARY OF THE INVENTION

In view of the foregoing disadvantages inherent in the known types of fabricated foam products now present in the prior art, the present invention provides a foam structure for use as packaging material which can be interlocked with other like designed structures to compose a block of building material.

A building block composed of previously used foam packaging material can reduce the production of packaging waste by creating a social and financial incentive to recycle such packaging material.

Utilizing foam packaging material to compose structural units of building material confers on them the benefits of the longevity of the foam materials.

Forming building material from foam packaging material also reduces the ecological impact of discarded foam packaging materials while creating building materials that will enable affordable housing for many.

Foam packaging material that can be interlocked into blocks of building material can also be conveniently stacked, inventoried, shipped and stored prior to its use as packaging material.

More specifically, aspects of the invention can be found in a foam structure for protecting a product in a package. The foam structure fits within the package and at least one side of it is formed to protect the product. The foam structure is also capable of interlocking with another foam structure, concrete or wood to form a structural unit of building material.

Other aspects of the invention can be found in a method of protecting a product in a package using building material components. One step in the method is placing at least one foam structure that is formed to fit within the package in contact with the product. The foam structure has at least one side formed to protect the product and it has a side capable of interlocking with an element to form a structural unit. The foam structure protects the product while the product is in contact with the foam structure within the package. The structural unit can be used as building material.

A further step in the method is shipping, storing or counting the foam structures while they are interlocked with other foam structures.

Aspects of the invention also can be found in a packing structure that has two nested parts, a first part formed to fit within a package and a second part formed to fit a product. Either part can interlock with another element to form a structural unit that can be used as building material. The two parts can be made of differing materials.

Other aspects of the invention can be found in a method of protecting a product in a package using building material components. One step in the method is joining two parts to form a shipping protection element that fits within the package and protects the product. At least one side of one of the parts is capable of interlocking with an element to form a structural unit that can be used as building material.

Further aspects of the invention can be found in a method of combining shipping protection structures to form building material. The shipping protection structure has two parts and it protects a product in a package. Steps in the method include disassociating the two parts of the shipping protection structure and joining at least one part with an element to form a structural unit that can be used as building material.

Other aspects of the invention can be found in a structural unit that can be used as building material, and that is made from packing material for a product in a package. The structural unit is made of at least two interlocked foam structures. At least one of the foam structures has at least one side formed to engage the product in the package, and it has a side capable of interlocking with another foam structure to form the structural unit. The foam structures are capable of inhibiting damage to the product in the package.

The foam structures can be secured with adhesive or with fastening devices to form the structural unit. The structural unit can be part of a construction product or a flotation product. The structural unit can be part of a wall form and can be attached to the wall with a connector. The structural unit can be attached to the other side of the wall form with a connector.

Aspects of the invention also can be found in a structural unit that can be used as building material, and that is made from packing material for a product in a package. The structural unit has at least one foam structure that is formed to fit in the package. The foam structure has at least one side that is formed to engage the product, and a side capable of interlocking with an element to form the structural unit. The foam structure is capable of inhibiting damage to the product in the package. The structural unit has a conduit.

The conduit can be formed within the foam structure or can be formed by the interlocking of the foam structure to the element. The conduit can be used for the passage of electrical conductors, air or a fluid. As before, the structural unit can be part of a wall form and can be attached to the wall with a connector. The structural unit can be attached to the other side of the wall form with a connector.

Further aspects of the invention can be found in a method of creating building material from packing material for a product in a package. One step in the method is combining a foam structure and an element to create a structural unit that can be used as building material. The foam structure is formed to fit within the package and has a first side that is formed to protect the product, and a side capable of interlocking with the element to form the structural unit.

As before, the foam structure and element can be secured with adhesive or with fastening devices to form the structural unit. The structural unit can be part of a construction product or a flotation product. The structural unit can be part of a wall form and can be attached to the wall with a connector. The structural unit can be attached to the other side of the wall form with a connector.

There has thus been outlined, rather broadly, the more important features of the invention in order that the detailed description thereof may be better understood, and in order that the present contribution to the art may be better appreciated. There are additional features of the invention that will be described hereinafter.

Other aspects, advantages and novel features of the present invention will become apparent from the detailed description of the invention when considered in conjunction with the accompanying drawings.

BRIEF DESCRIPTION OF THE DRAWINGS

For a more complete understanding of the present invention and the advantages thereof, reference should be made to the following Detailed Description taken in connection with the accompanying drawings in which.

DETAILED DESCRIPTION OF THE PREFERRED EMBODIMENT

Figure 1:
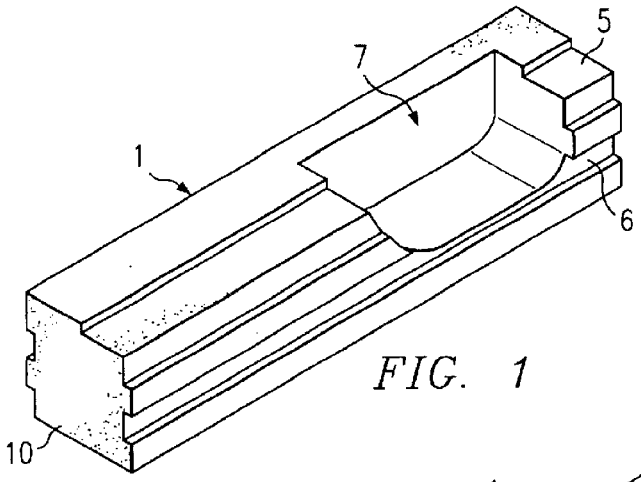
FIG. 1 is a perspective view of a piece of foam packing material that can interlock to form building material according to the invention.

For a more complete understanding of the present invention and advantages thereof, reference is now made to the following description taken in conjunction with the accompanying drawings in which like reference numbers indicate like features and wherein:

FIG. 1 depicts a foam structure 1 according to the invention for protecting a product while packed. Sides 5 and 6 of the structure are designed to interlock with other elements bearing a similar set of features. Side 10 of the structure is smooth. Cavity 7 is formed in sides 5 and 6 to accept an outer contour of a product, which the foam structure will protect when used as packing material.

Figure 2:
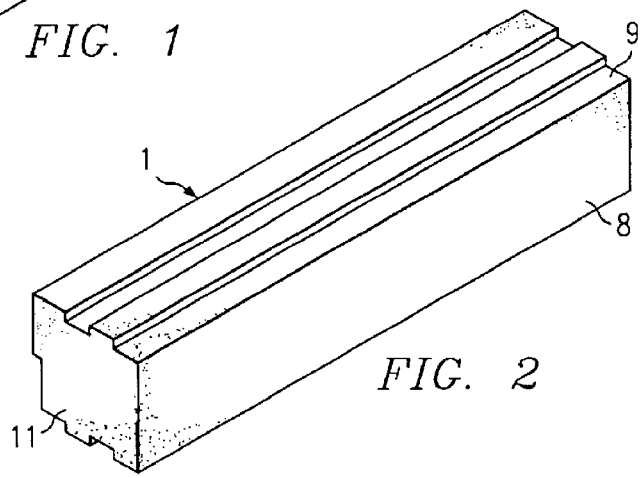
FIG. 2 is the reverse view of the foam structure of FIG. 1.

FIG. 2 shows the other three sides of the foam structure of FIG. 1. Sides 8 and 11 are smooth and side 9 is designed to interlock with side 6 or side 9 of a like designed structure.

Figure 3:
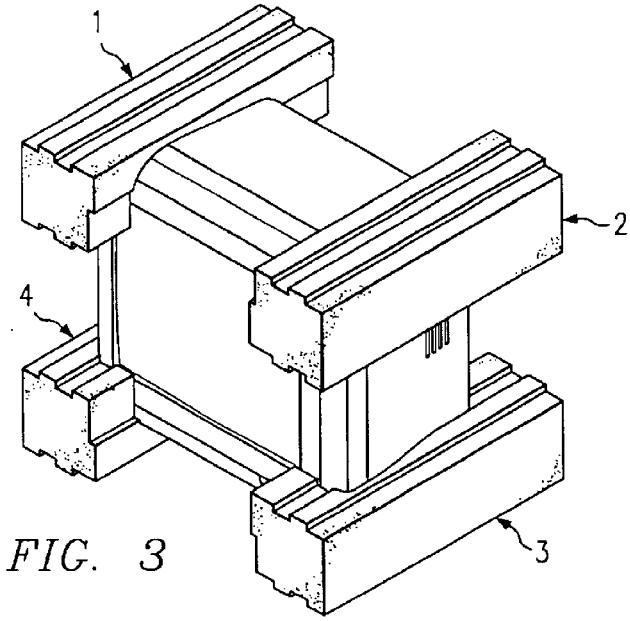
FIG. 3 shows the foam structures of the invention being used to package a product.

FIG. 3 illustrates structure 1 and like designed structures 2, 3 and 4 placed around a product. In this exemplary embodiment of the invention, the product is not robust and the product and foam structures would be placed inside a box for storage or shipping. If the product were robust, heavy duty plastic wrap, shrink wrap plastic, strapping tape or the like could be used to secure the foam structures around the product and package it for shipping or storage.

Figure 4:
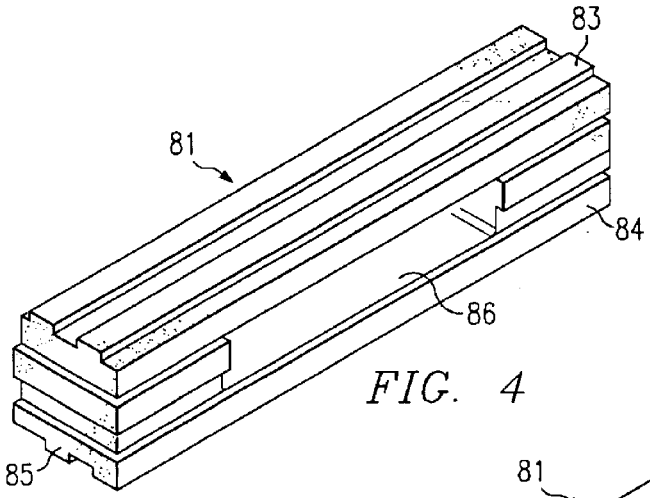
FIG. 4 is a perspective view of alternative foam structure according to the invention.

Another exemplary embodiment of the invention is presented in FIG. 4. Foam structure 81 has a common interlocking pattern on sides 83, 84 and 85. Structure 81 has cavity 86 formed in side 84 to accept an outer contour of a product.

Figure 5:
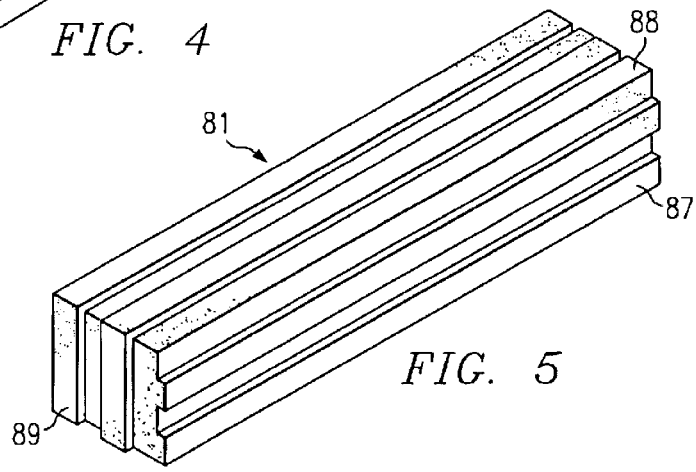
FIG. 5 is the reverse view of the foam structure of FIG. 4.

The other sides of foam structure 81 are shown in FIG. 5. It can be seen that sides 87, 88 and 89 have the same interlocking pattern as the three sides of structure 81 visible in FIG. 4. Thus any of the six sides of structure 81 can interlock with any side of another like designed structure, or with sides 6 or 9 of structure 1 in FIG. 1.

Figure 6:
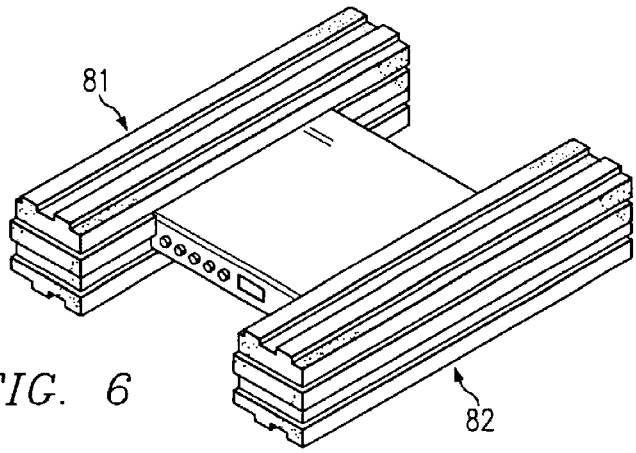
FIG. 6 shows the foam structure of FIG. 4 being used to package a product.

Foam structure 81 and like designed structure 82 can be seen in FIG. 6 engaging a product, ready to be placed in a box or other shipping container. Again, if the product is robust, other methods could be used to secure the product within the foam structures and package it for further handling.

Figure 7:
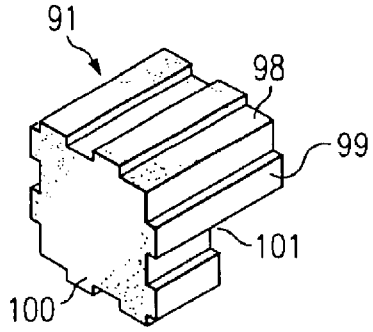
FIG. 7 is a perspective view of another foam structure according to the invention.

FIG. 7 presents yet another exemplary embodiment of the invention. Sides 98, 99 and 100 of foam structure 91 are visible, and it can be seen that sides 98 and 99 are patterned to interlock with each other or with any of the sides of structure 81 of FIG. 4. Side 100 of structure 91 in FIG. 7 is smooth. Cavity 101 is formed in three sides of structure 91, side 99, visible in FIG. 7, and sides 102 and 104, visible in FIG. 8.

Figure 8:
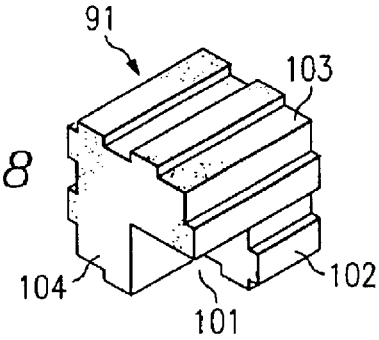
FIG. 8 is the reverse view of the foam structure of FIG. 7.

Still referring to FIG. 8, which shows the reverse sides of structure 91, side 104 is smooth, while sides 102 and 103 have the same interlocking pattern as sides 98 and 99.

Figure 9:
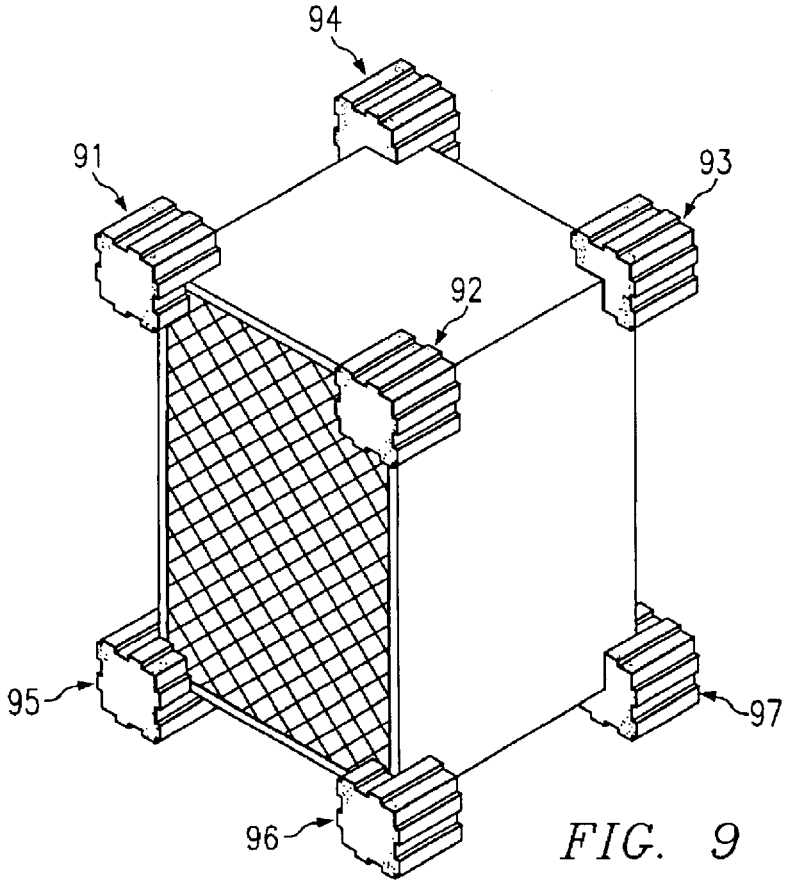
FIG. 9 shows the foam structure of FIG. 7 being used to package a product.

In FIG. 9, foam structure 91 and like designed structures 92 through 97 are seen engaging seven corners of a product, to serve as packing material when they are placed inside a shipping or storage container. An eighth like designed foam structure engaging the remaining corner of the product is not visible in FIG. 9.

Figure 10:
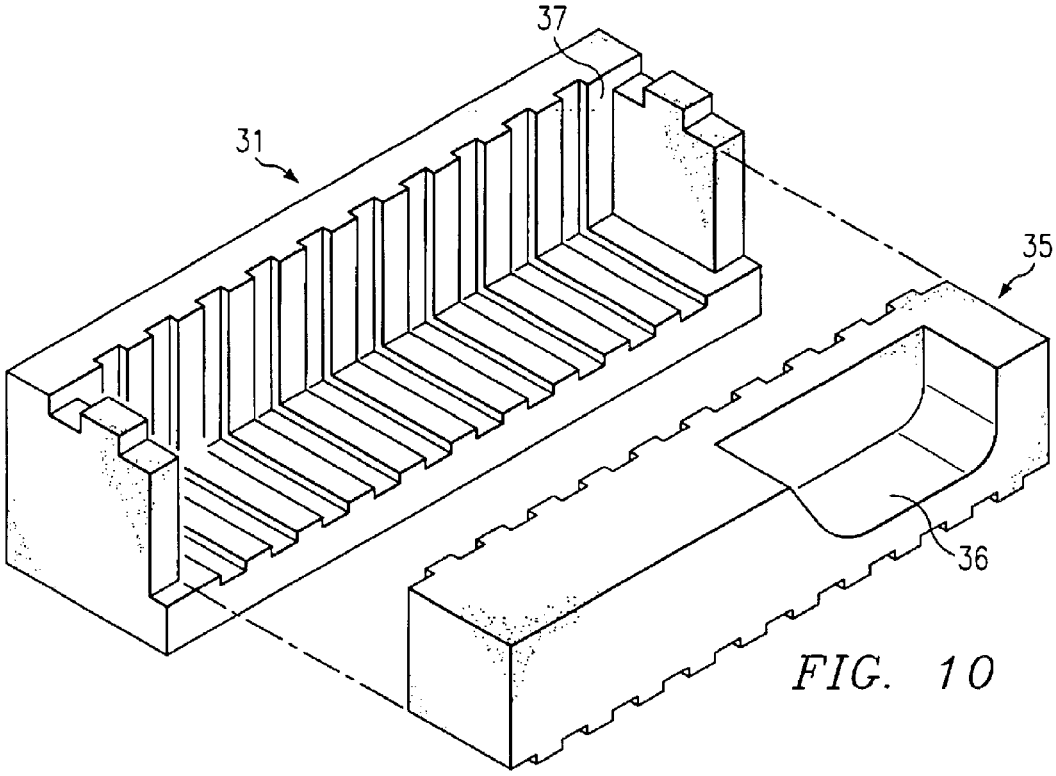
FIG. 10 is a foam structure and an insert formed to nest together and to hold a product for packaging.

Another exemplary embodiment of the foam structures of the present invention is depicted in FIG. 10. Foam structure 31 is formed with a standardized cavity 37 into which can be inserted another structure 35 with a cavity 36 created to fit the outer contour of a product. In this way, a standardized foam structure 31 could be produced and used to package a variety of different products by utilizing customized structures 35 for each different product.

Alternatively, structure 31 could be made from expanded polypropylene, a more durable material than expanded polystyrene, while structure 35 is made from the less expensive material, expanded polystyrene. When packing material of this design is received for recycling, the structure 35 could be removed and used, according to the invention, to form building material. Structure 31 could be reused with a different insert as packaging material, until such time as it too is used, according to the invention, to form building material.

If common interlocking patterns are used on the sides of structures 31 and 35, they can be left nested before they are used to form building material or they can be disassociated and used separately. Two parts 31, two parts 35 or one part 31 and one part 35 could be interlocked.

Figure 11:
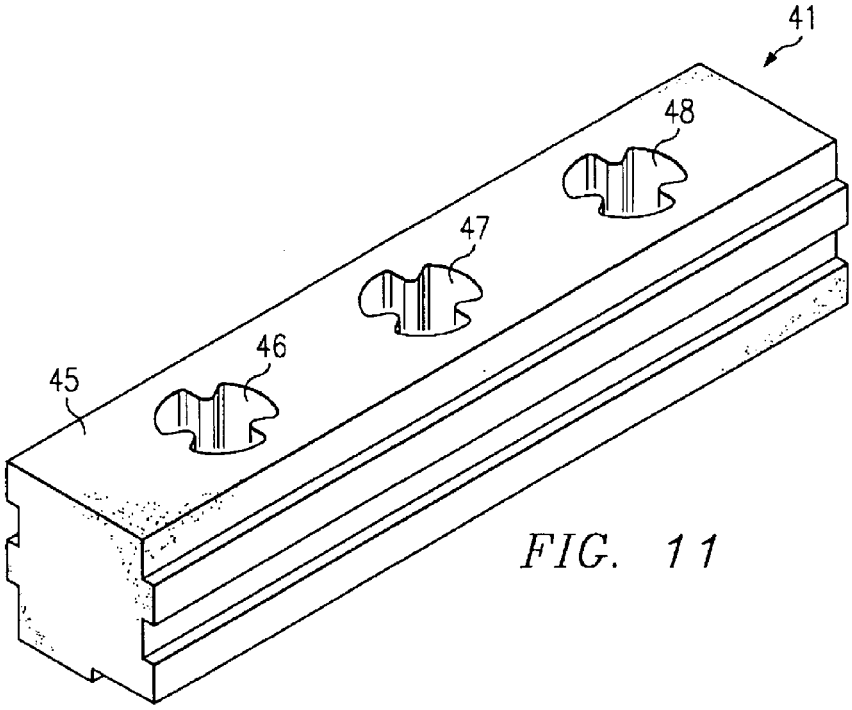
FIG. 11 depicts an alternative foam structure according to the invention.

Smaller products may not need to be packaged in four foam structures, as shown in FIG. 1. Foam structure 41 illustrated in FIG. 11, having cavities 46, 47 and 48 formed in product packaging side 45, could be used on its own to package, in this exemplary embodiment, three cylindrical products for shipping. Cavities 46, 47 and 48 are fitted with raised contact points, which compress to absorb force when the packaged product is subjected to the sharp deceleration of being dropped or bumped. Shrink-wrap plastic, strapping tape, or a box or other container could be used to package the products in the foam structure. Alternatively, two foam structures 41 could be placed with their product packaging sides 45 in contact, thereby completely surrounding the packaged product in mating cavities 46, 47 and 48. Again, shrink-wrap plastic, strapping tape, a box or the like could be used to package the products within the foam structures.

The foregoing discussion has described several exemplary embodiments of the foam structures of the invention and their uses as packing material. In view of these descriptions and drawings, other modifications and variations will now become apparent to those skilled in the use of foam structures as packing material. It should also be apparent that such other modifications and variations may be effected without departing from the spirit and scope of the present invention.

Figure 12:
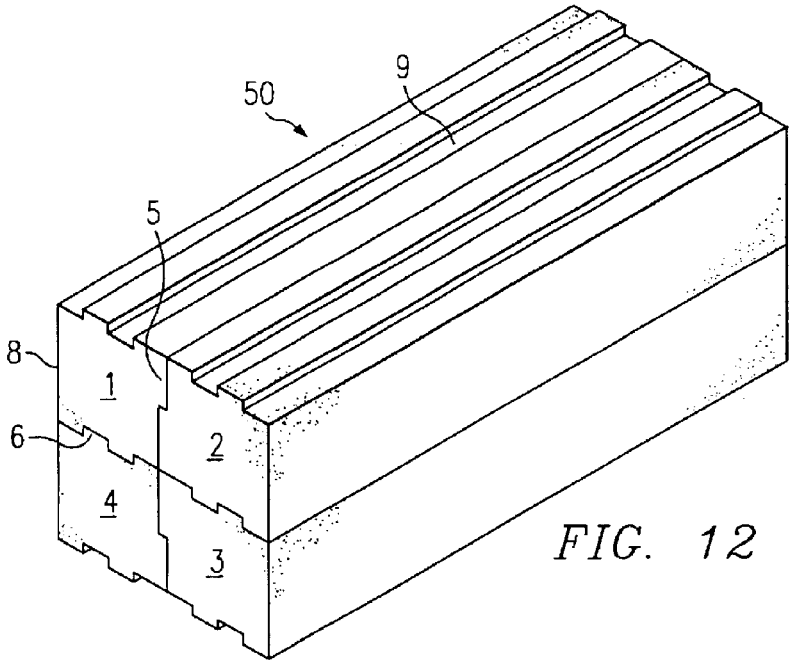
FIG. 12 depicts building material composed according to the invention.

Illustrating now the formation of building material according to the invention, FIG. 12 shows foam structures 1, 2, 3 and 4 interlocked to form structural unit 50. It can be seen that sides 5 and 6 of foam structure 1 interlock with like designed sides of foam structures 2 and 4, respectively. Side 9 of foam structure 1 and the corresponding sides of foam structures 2, 3 and 4 form an outer side of unit 50 that can interlock with a side of a unit composed of like designed foam structures. When a number of units 50 are stacked to form a wall, the wall will have a smooth face made up of side 8 of foam structure 1 and the corresponding smooth sides of foam structures 2, 3 and 4.

The interlocking features of the foam structures composing structural unit 50, and the features that interlock unit 50 to other like composed units when used to create a wall, panel or other structure, prevent drafting or air seepage through and between the units. The foam structures of FIG. 6, having interlocking patterns on all six sides, provide this benefit to an even greater degree. This benefit is also obtained with the other embodiments of the invention illustrated herein.

The particular interlocking feature pattern shown on side 6 and 9 of foam structure 1 in FIG. 12 also has the benefit of allowing unit 50 and other like designed units to interlock when laid in the staggered pattern commonly used for brick laying. It has the further benefit of allowing units of different lengths to be combined to compose a wall, panel or other structure. It should be understood, however, that other interlocking patterns could be used that do not provide these two particular benefits, while still falling within the spirit and scope of the present invention.

Figure 13:
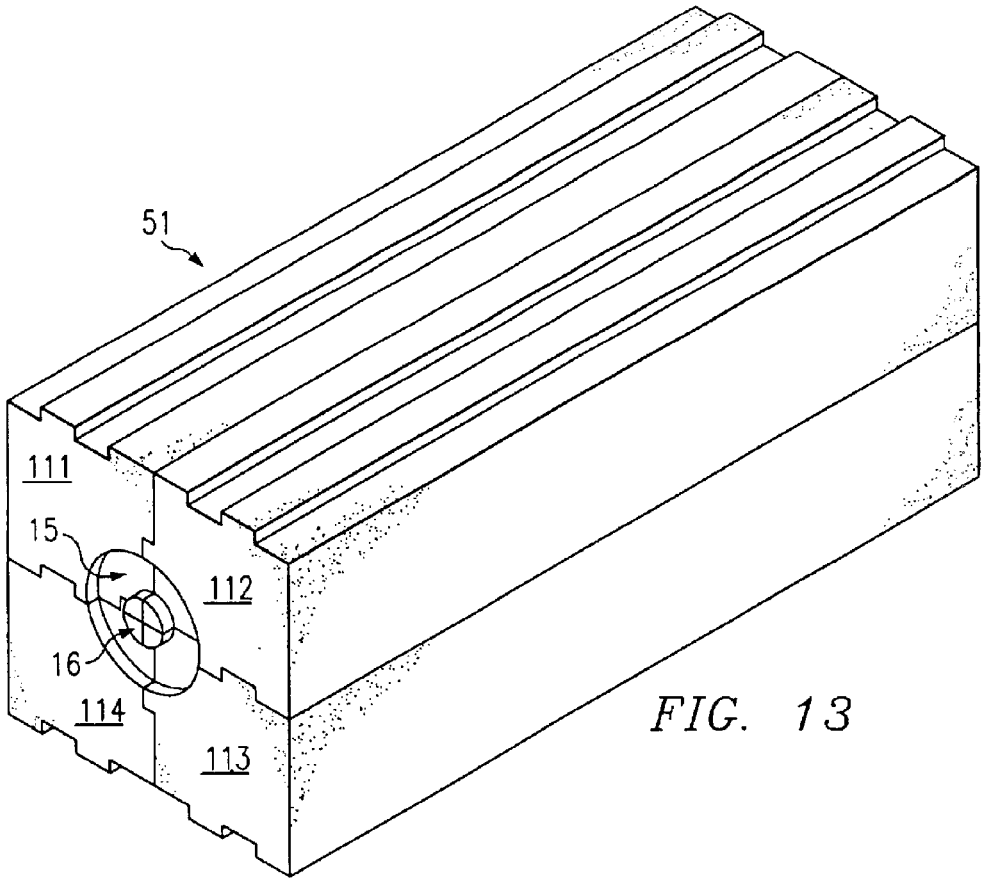
FIG. 13 illustrates building material composed according to the present invention from alternative foam structures.

In another exemplary embodiment of the invention, FIG. 13 shows a structural unit 51 made from foam structures 11, 12, 13 and 14. These foam structures have features molded into their sides that form post 16 surrounded by annular cavity 15 when the foam structures are combined to form unit 51. A rubber band or other fastening device can be placed around post 16 to hold the foam structures together while unit 51 is being handled.

Figure 14:
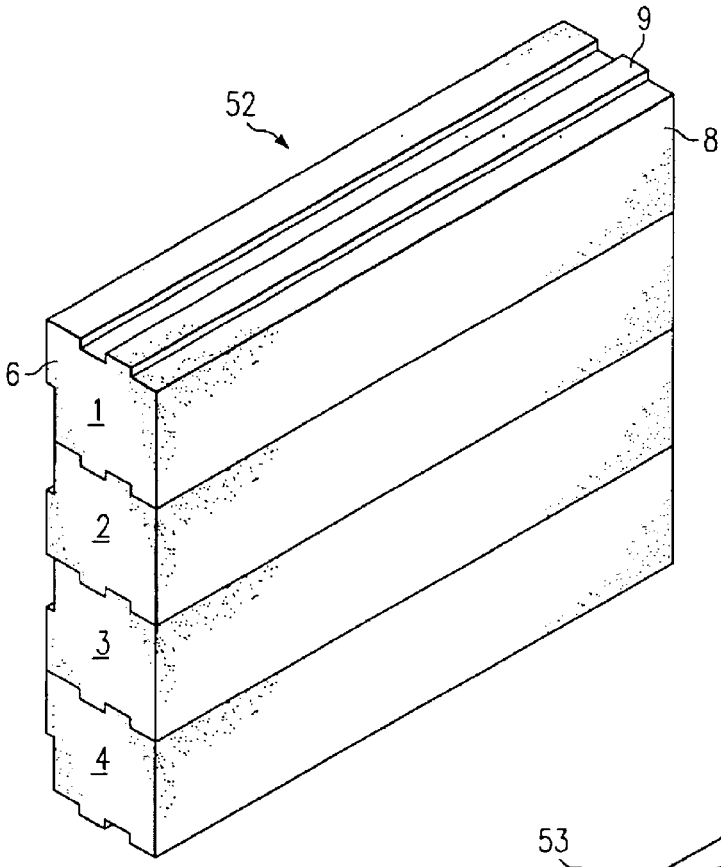
FIG. 14 depicts building material alternatively composed according to the invention.

Foam structures 1, 2, 3 and 4 are shown stacked in FIG. 14 to form structural unit 52 in another exemplary embodiment of the invention. In this embodiment, side 9 of foam structure 1 forms the upper side of unit 52, while side 6 of foam structure 1 interlocks with a side of foam structure 2. Structures 3 and 4 are similarly stacked beneath structure 2 to form structural unit 52 Side 8 of foam structure 1 and the corresponding smooth sides of structures 2, 3 and 4 are oriented in the same direction to give unit 52 a smooth side. However, it can be seen that the foam structures could also be stacked with smooth structure sides appearing on both sides of unit 52.

Figure 15:
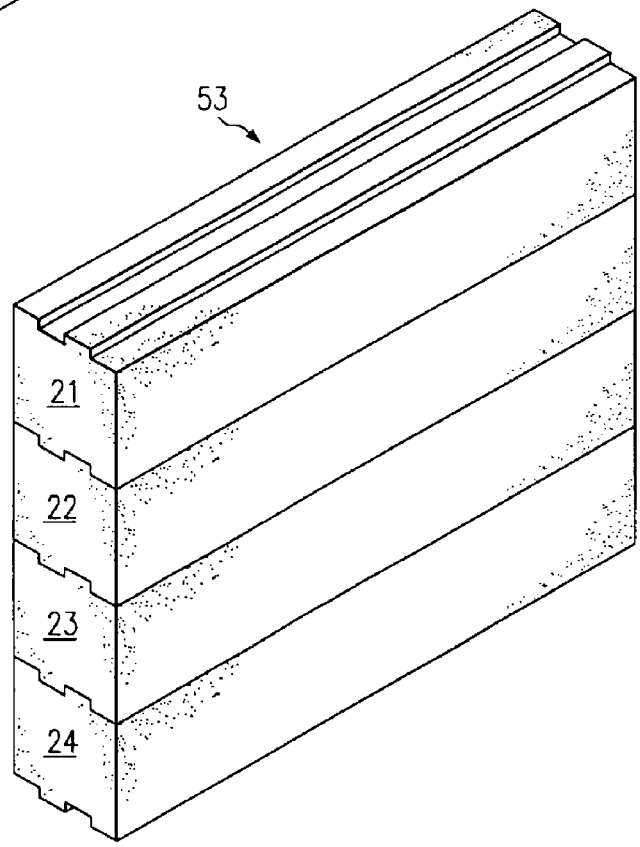
FIG. 15 shows building material of FIG. 14 composed from an alternative foam structure.

In yet another exemplary embodiment of the invention, FIG. 15 shows a structural unit 53 composed of foam structures 21, 22, 23 and 24. These foam structures are comparable to previously described foam structures 1, 2, 3 and 4, except for the lack of protrusions on side 5 of foam structure 1 and on the corresponding side of foam structures 2, 3 and 4. Side 5 and the corresponding sides of the other foam structures 21, 22, 23 and 24 are smooth, except for the cavity formed to accept the product they protect when used as packing material.

Cavities in the side walls of structural unit 53 of FIG. 15 or in the interior of unit 50 of FIG. 12, or in the other embodiments shown herein, can be filled with additional material for the purpose of improving the insulating properties of the unit, and, in the case of external cavities, for the purpose of presenting a smooth side wall on the unit. This additional material could be hardened liquid foam, loose fill insulation, blown insulation, a fitted piece of molded foam, or other like material.

Figure 16:
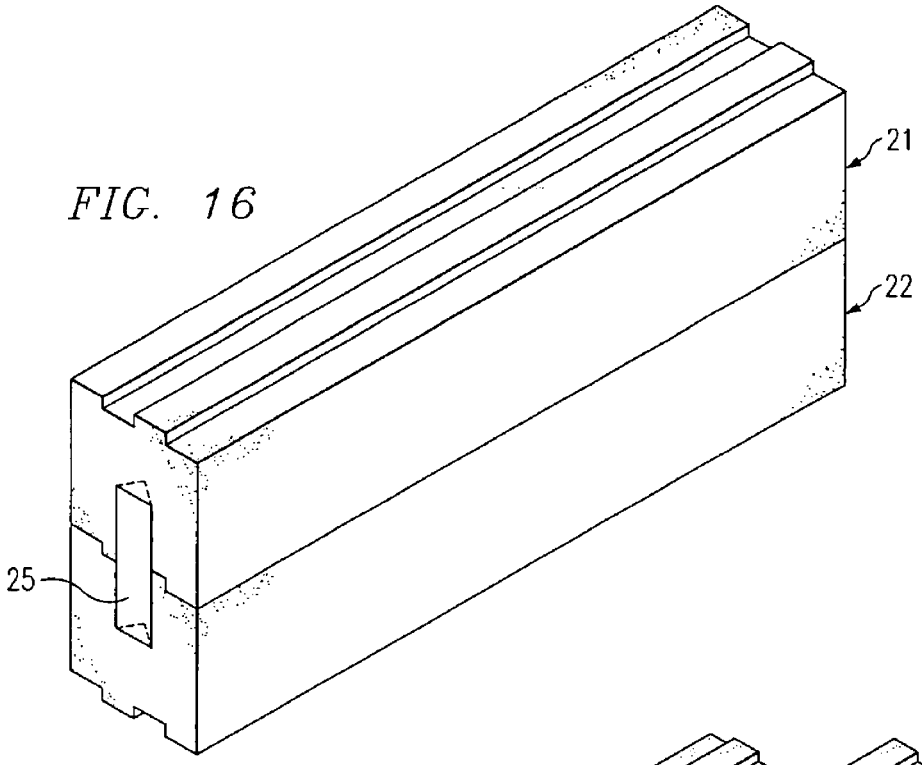
FIG. 16 shows foam structures stacked according to the invention for shipping, storage or inventory purposes.

FIG. 16 shows a portion of the structural unit 53 of FIG. 15, depicting fastening device 25 being used to secure foam structures 21 and 22 to each other. Another such fastening device (not shown) can be used at the other end of the foam structures to further secure them to each other. Likewise, additional fastening devices can be used to secure the other foam structures of structural unit 53 to each other. By so doing, unit 53 can be prevented from separating into its component foam structures.

Figure 17:
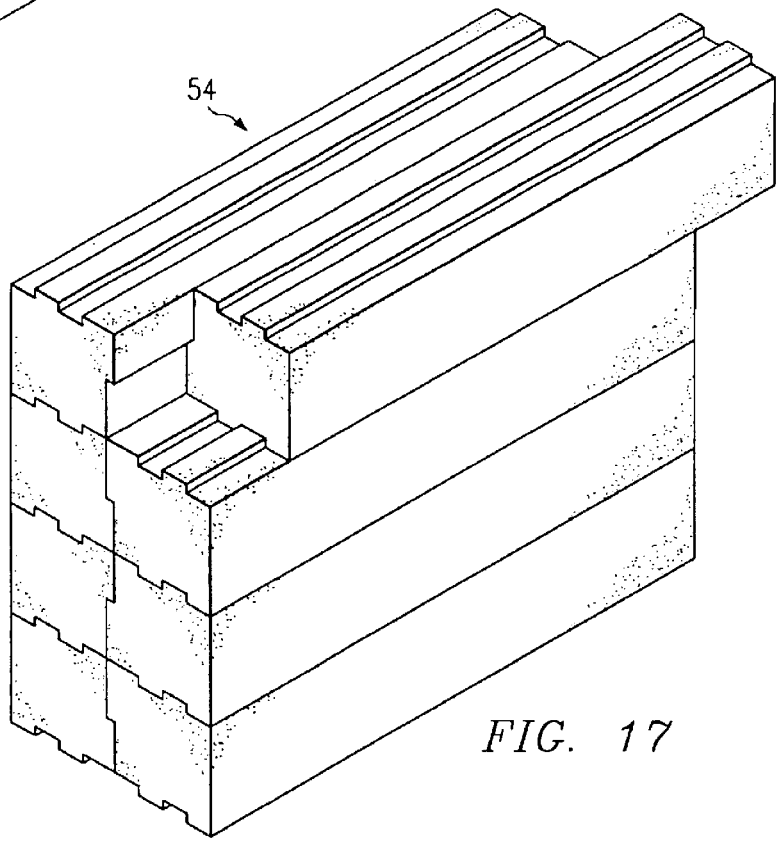
FIG. 17 illustrates building material composed according to the invention for use in a wall form with a connector for attaching it to the wall.

FIG. 17 illustrates yet another advantage of the present invention. The foam structures can be assembled into a large bundle 54 for ease of shipping and storage prior to their use as packing material. Additionally, the total number of foam structures in such a bundle 54 can be easily calculated by counting the number of structures across the bottom and the number down the side and multiplying those two numbers.

Walls constructed from pourable building material (e.g., pourable concrete) are conventionally formed by erecting two wall form panels with a cavity between them and pouring the building material into the cavity. Often, one or both wall form panels are formed of foam material and the panel is left in place after the wall material has cured, to form thermal and acoustic insulation for the finished wall.

The structural units of the present invention can be used to assemble wall form panels for this purpose. When this is done, any interlocking pattern on the sides of the component foam structures exposed to the inside of the wall form will be captured by the pourable building material when it cures, thereby interlocking the structural units to the wall.

Figure 18:
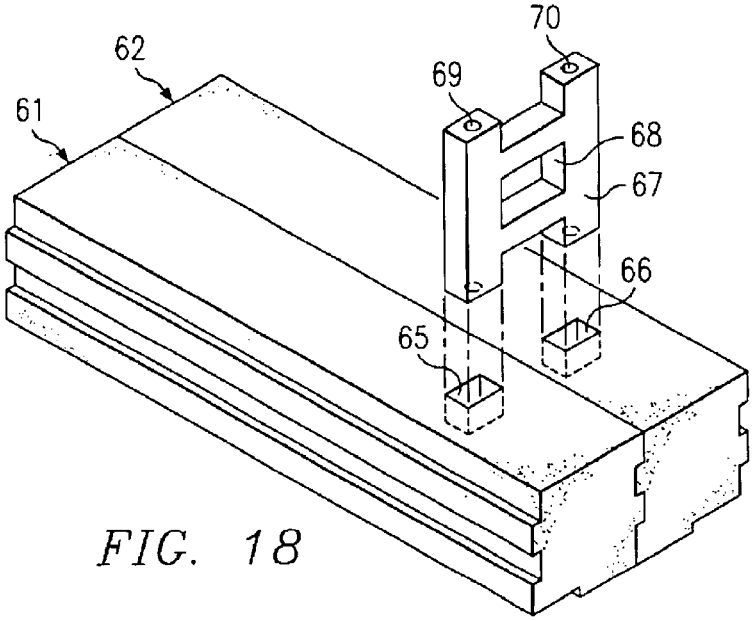
FIG. 18 depicts building material composed according to the invention and containing conduits.

Structural units can also be attached to the finished wall through the technique shown in FIG. 18. Foam structures 61 and 62 are shown having orifices 65 and 66, respectively, for receiving connector 67. Alternatively, after foam structures are assembled to compose a structural unit, orifices 65 and 66 could be formed in the unit at the desired location for connector 67. Connector 67 may reach partially across the cavity between the two wall form panels. When pourable building material is subsequently poured into the wall form it will flow past the connector 67 and into the cavity 68 in the connector and, once cured, capture the connector in the wall thus formed. Connector 67 will then serve to attach the structural unit composed of foam structures 61 and 62 to the finished wall.

Alternatively, connector 67 may reach fully across the cavity and attach the two wall form panels together prior to the pouring of the pourable building material. If the other wall form panels are composed of structural units of the present invention, connector 67 may be received in orifices, as described for foam structures 61 and 62. If plywood or other material is used for the other wall form panel, the connector 67 may be provided with holes 69 and 70 for receiving a fastener to attach the connector to the other wall form panel.

Structural units of building material composed, according to the invention, of foam structures used for product packaging can be used for the creation of other construction products than the wall forms discussed above. Structural insulated panels can be formed by assembling such foam structures into a panel and cladding the panel with particleboard or other such material. The cladding material may be provided with an interlocking pattern matching that found on the foam structures, thereby interlocking the cladding material to the foam structures. Structural units formed from foam structures can be used to build retaining walls and facades. In a further example, structural units composed according to the invention can be built into a panel, covered with a wire mesh, and concrete or stucco blown onto the mesh to form a wall or fence.

Structural units composed according to the invention can also be used to form flotation products such as floats for boat docks or as filler for pontoons.

Figure 19:
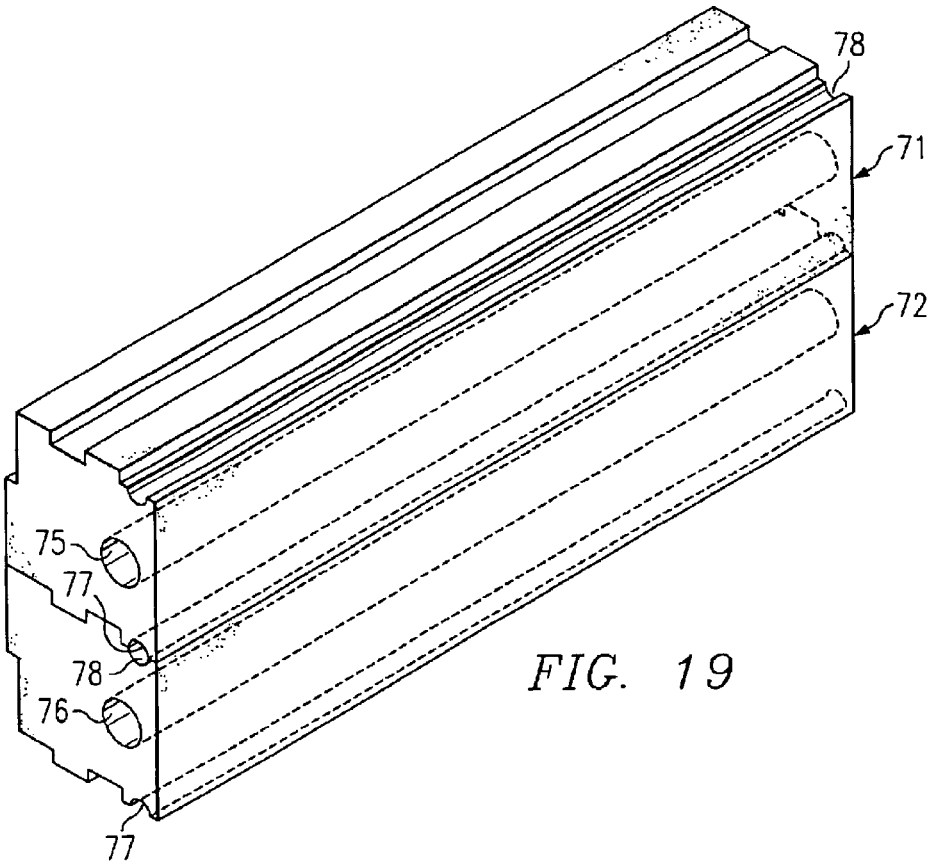
FIG. 19 is a view of two foam structures according to the invention secured by a fastening device.

FIG. 19 depicts foam structures 71 and 72 in another exemplary embodiment of the invention. Conduits 75 and 76 are formed extending through foam structures 71 and 72, respectively, to allow the passage of items such as pipes, electrical cables, ducts and the like. When structural units composed of like designed foam structures are stacked end to end as part of a wall or panel, a continuous conduit will be formed, allowing the passage of such items along the length of the wall or panel.

Foam structures 71 and 72 can also be molded with cavities 77 and 78 in the side. In this way, when the foam structures are interlocked to create a structural unit, the mating cavities form a conduit extending through the unit, as illustrated in FIG. 19. Cavity 77 or 78 could be formed in any side of the foam structure, and it will form a conduit when interlocked with any other element, even one without a matching cavity.

Air can be passed through the conduit without using a duct by placing a liner along the inside of the conduit prior to composing the foam structures into a structural unit. Alternatively, the conduit can be left untreated and the air allowed to pass along the raw foam conduit.

Similarly, water or other fluid can be passed through the conduit without using a pipe by placing a liner along the inside of the conduit, or by treating the surface of the conduit with a waterproof sealant. When a conduit is formed from mating semi-cylindrical cavities 77 and 78, the foam structures would be joined with adhesive or other sealant to prevent fluids leaking between them. For a similar reason, foam structures abutted end to end would be sealed with adhesive or other sealant to form an extended conduit for carrying fluid.

Yet another benefit is obtained if conduits 75 and 76 or semi-cylinders 77 or 78 lead into the product cavity formed in the foam structure, for example, cavity 86 in side 84 of structure 81 of FIG. 4. If side 84 is positioned on an outer side of a structural unit such as a structural insulated panel (SIP), a hole may be cut in the cladding material for mounting an electrical outlet box. Cavity 86 would then provide empty space in the SIP to receive the outlet box and the conduit would provide space for the passage of the electrical cables connected to the outlet box. Louvers for directing air could be similarly mounted over cavity 86 to provide an outlet for air passing through a conduit in the structural unit.

Many structural units made of two and four foam structures have been described specifically above. Of course, many different units and interlocking designs as well as any number of interlocked foam structures may be used within the scope of this disclosure.

As such, an apparatus and method for a foam structure for protecting a product while packed which may be used to compose building material is described. In view of the above detailed description of the present invention and associated drawings, other modifications and variations will now become apparent to those skilled in the art. It should also be apparent that such other modifications and variations may be effected without departing from the spirit and scope of the present invention as set forth in the claims which follow.

What is claimed is:

1. A method for forming a packaging system and for subsequently forming a structural unit from components of the packaging system, the method comprising:

forming a packaging unit by removably mating each of a plurality of three-dimensional elements with respective portions of a product, each of the three-dimensional elements having a cavity that removably mates with a respective portion of the product so that that plurality of three-dimensional objects reside in a first configuration;

placing the packaging unit into a shipping container to form the packaging system;

shipping the packaging system;

removing the packaging unit from the shipping container;

removing the plurality of three-dimensional elements from their respective portions of the product; and interlocking the plurality of three-dimensional elements using interlocking structure formed on the plurality of three-dimensional elements to form the structural unit with the plurality of three-dimensional objects residing in a second configuration that differs from the first configuration.

2. The method of claim 1, wherein:

the plurality of three-dimensional elements comprise eight three-dimensional elements;

the packaging unit includes eight corners; and forming the packaging unit includes removably mating each of the eight three-dimensional elements with eight corresponding corners of the product.

3. The method of claim 1, wherein:

the plurality of three-dimensional elements comprise two three-dimensional elements; and each of the two three-dimensional elements corresponds to a respective half of the packaging unit.

4. The method of claim 3, wherein forming the packaging unit includes removably mating each of the two three-dimensional elements with respective sides of the product.

5. The method of claim 1:

wherein the interlocking structure comprises a tongue and groove structure formed in surfaces of the three-dimensional element; and wherein the interlocking structure of one three-dimensional element exactly meeting the interlocking structure of another of the three-dimensional elements.

6. The method of claim 1, wherein the plurality of three-dimensional elements are foam structures.

7. The method of claim 1, further comprising using the structural unit in the construction of a building.

8. The method of claim 1, further comprising using the structural unit as a flotation product.

9. The method of claim 1, further comprising using the structural unit to create a portion of a wall form for pourable building material.

10. The method of claim 1, further comprising coupling together the plurality of three-dimensional elements using a connector that fits through a connector opening formed in the plurality of three-dimensional elements.

11. A packaging system comprising:

a product;

a plurality of three-dimensional elements;

at least one product receiving cavity formed in each of the plurality of three-dimensional elements, each product receiving cavity receiving a respective portion of the product when the plurality of three-dimensional elements are removably mated to the product in a shipping configuration in which the product and the plurality of three-dimensional elements form a packaging unit;

a container in which the packaging unit resides; and interlocking structure formed on each of the plurality of three-dimensional elements, wherein the interlocking structure of each three-dimensional element is formed to exactly meet the interlocking structure of at least one other three-dimensional element of the plurality of three-dimensional elements to facilitate construction of a structural unit from the plurality of three-dimensional elements.

12. The packaging system of claim 11, wherein:

the plurality of three-dimensional elements comprise eight three-dimensional elements;

the packaging unit includes eight corners; and each of the eight three-dimensional elements corresponds to a respective corner of the six corners.

13. The packaging system of claim 11, wherein:

the plurality of three-dimensional elements comprise two three-dimensional elements; and each of the two three-dimensional elements corresponds to a respective half of the packaging unit.

14. The packaging system of claim 11, wherein each of the two three-dimensional elements further comprises a cavity that removably mates with a respective side of the product in the shipping configuration.

15. The packaging system of claim 11, wherein the interlocking portion comprises a tongue and groove structure formed in a surface of the three-dimensional element.

16. The packaging system of claim 11, wherein the plurality of three-dimensional elements are foam structures.

17. The packaging system of claim 11, wherein the structural unit comprises a construction product.

18. The packaging system of claim 11, wherein the structural unit comprises a flotation product.

19. The packaging system of claim 11, wherein each of the plurality of three-dimensional elements further comprises a connector opening adapted to receive a connector for joining the plurality of three-dimensional elements as the structural unit.

20. A packaging system comprising:

a product having eight corners;

eight three-dimensional elements;

at least one product receiving cavity formed in each of the eight three-dimensional elements, each product receiving cavity receiving a respective corner of the product when the eight three-dimensional elements are removably mated to the product in a shipping configuration in which the product and the plurality of three-dimensional elements form a packaging unit;

a container in which the packaging unit resides; and interlocking structure formed on each of the eight three-dimensional elements, wherein the interlocking structure of each three-dimensional element is formed to exactly meet the interlocking structure of at least one other three-dimensional element of the eight three-dimensional elements to facilitate construction of a structural unit from the eight three-dimensional elements.

* * * * *